US006551132B1

(12) United States Patent
Kuo

(10) Patent No.: US 6,551,132 B1
(45) Date of Patent: Apr. 22, 2003

(54) STACKED ELECTRICAL CARD CONNECTOR ASSEMBLY

(75) Inventor: Ming Lun Kuo, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/028,641

(22) Filed: Dec. 19, 2001

(51) Int. Cl.[7] ..... H01R 13/60
(52) U.S. Cl. ..... 439/541.5; 439/607
(58) Field of Search ..... 439/541.5, 607, 439/79, 62, 64, 630

(56) References Cited

U.S. PATENT DOCUMENTS 5,713,747 A * 2/1998 Hsia et al. ..... 439/79
5,967,803 A * 10/1999 Ho ..... 439/79
6,062,904 A * 5/2000 Oguchi et al. ..... 439/541.5
6,287,129 B1 * 9/2001 Kuo ..... 439/79
6,296,518 B1 * 10/2001 Avery et al. ..... 439/541.5

* cited by examiner

*Primary Examiner*—Hien Vu
(74) *Attorney, Agent, or Firm*—Wei Te Chung

(57) ABSTRACT

A stacked electrical card connector assembly (1) includes an upper connector (10), a lower connector (20), and a transition-PCB (30) connecting with both the upper connector and the lower connector. The upper connector has an upper header (12) comprising an insulative main body (14) having a plurality of first signal contacts (15). The lower connector (2) has an insulative lower header (22), a metallic frame (24) having an opening (144), and a contact module (18) having a plurality of second signal contacts (182) receiving in the opening. The transition PCB has a first contacting portion (32) connected with the first and second signal contacts and a second contacting portion (34) connected with a mating connector (4).

2 Claims, 7 Drawing Sheets

STACKED ELECTRICAL CARD CONNECTOR ASSEMBLY

BACKGROUND OF THE INVENTION

1. Field of the Invention

The present invention relates to the art of electrical connectors, more particularly to an improved electrical connector assembly for connecting one or more electrical cards to a printed circuit board (PCB).

2. Description of the Related Art

With the tendency of reducing the size of a computer device, demand has arisen for increasing its data storage capacity at low cost. Generally, electrical cards, such as memory cards, are data storage devices which are electrically connected to the computer device. The electrical cards are portable instruments that are readily inserted into and extracted from electrical connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors are arranged in "dual port" or stacked configurations. Examples of this electrical connector assembly are disclosed in U.S. Pat. Nos. 5,324,204 and 5,688,130. Such electrical connector assembly commonly includes an upper connector and a lower connector stacked together for receiving individual electrical cards therein and respectively electrically connecting the electrical cards to a PCB. This electrical connector assembly meets the requirement of high-capacity data transmission since it can simultaneously receive two same or different types of electrical cards therein. However, the overall size of the electrical connector assembly is not reduced at all since the electrical connector assembly simply stacks two individual electrical connectors together. It is not suitable to install such electrical connector assembly in a Notebook-PC for it occupies too much space. Furthermore, data transmission of the electrical connector assembly is achieved through independent signal contacts in an upper header of the upper connector and a lower header of the lower connector, and the signal contacts have to be directly soldered to the PCB or be connected to the PCB through a separate transition device soldered on the PCB. One problem associated with soldering the entire signal contacts of the connector assembly to the PCB is that it is difficult to solder each individual tail and ensure that none of the closely spaced solder pads is short circuited to an adjacent solder pad. In addition, if the connector assembly need be replaced or removed from the PCB, the unsoldering process can be extremely labor intensive and costly.

Therefore, the present invention is directed to solving the above problems by providing a low-profile stacked electrical connector assembly which can be used for receiving two electrical cards therein. A copending application filed Dec. 17, 2001, with an Ser. No. 10/023,613, the same applicant, the same assignee and the same title discloses some approach.

SUMMARY OF THE INVENTION

Accordingly, an object of the present invention is to provide a stacked electrical connector assembly having reduced height thereby saving the occupied space on a PCB where the connector assembly is mounted.

Another object of the present invention is to provide a stacked electrical connector assembly with improved transition device which simplifies the assembling process of the connector assembly.

To achieve the above objects, a stacked electrical card connector assembly in accordance with the present invention comprises an upper connector, a lower connector, and a transition device respectively connected with the upper and lower connectors. The upper connector has an insulative upper header and a shield covering the upper header. The upper header comprises a plurality of first signal contacts defined therein and a contacting module assembled under the first signal contacts having a plurality of second signal contact defined therein. The shield has a plurality of grounding pins extending out from an edge thereof. The lower connector has an insulative lower header and a metallic lower frame assembled to the lower header, the lower frame has an opening defined at one end thereof thereby receiving part of the contacting module therein. The transition device has a first contacting portion and a second contacting portion. The first contacting portion has a plurality of solder holes respectively receiving the first signal contacts, the second contacts and the ground pins of the shield therein. The second contacting portion is connected with a mating connector mounted on a PCB.

With such a design, data of different electrical cards received in the upper and lower connectors can be transferred through one transition device thereby decreasing the whole height of the connector assembly. The transition device can be connected to a PCB without soldering the transition device to the PCB such that the assembling progress is simplified.

Other objects, advantages and novelty features of the invention will become more apparent from the following detailed description when taken in conjunction with the accompanying drawings.

DESCRIPTION OF THE PREFERRED EMBODIMENT

Figure 1:
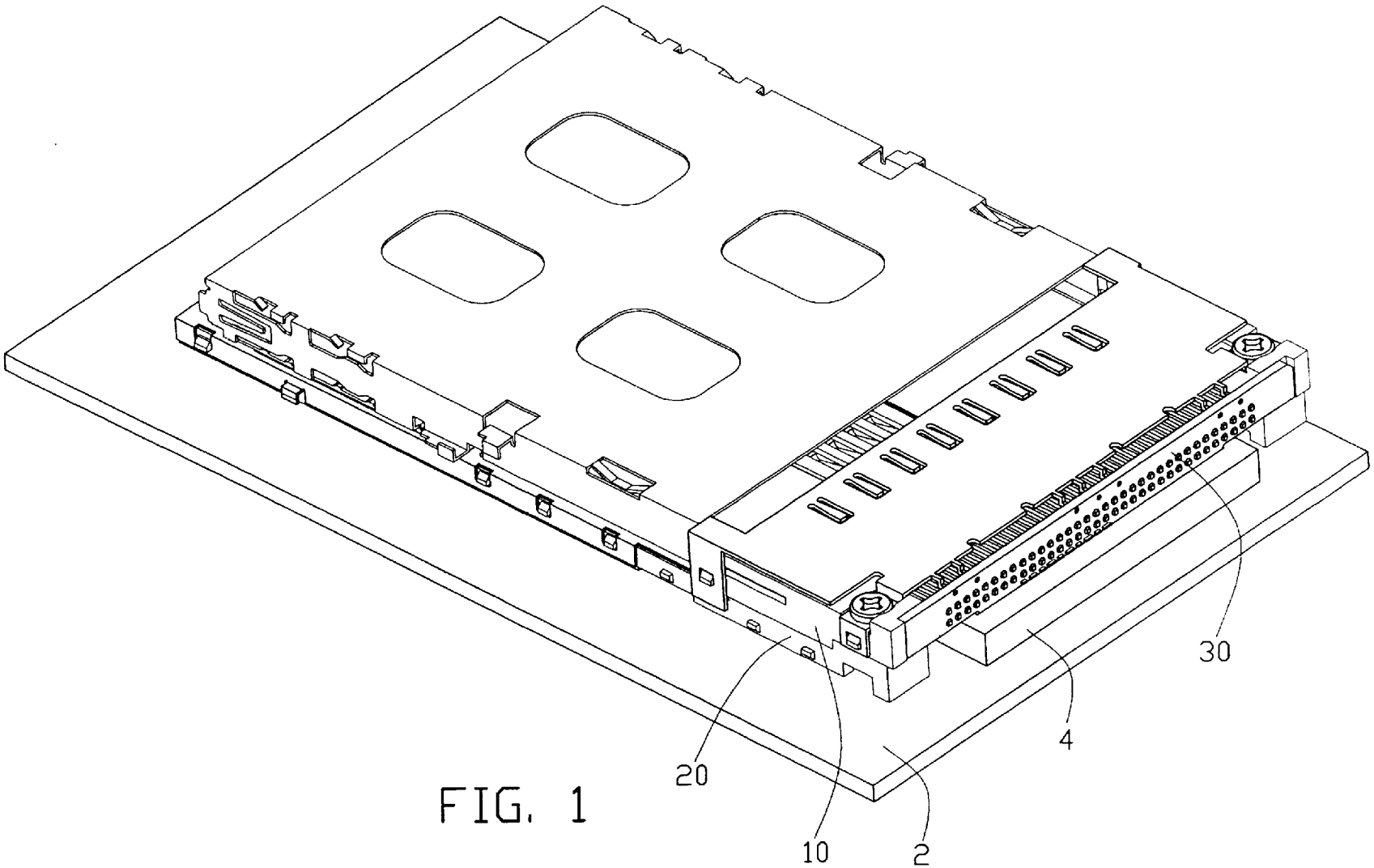
FIG. 1 is an assembled view of a stacked electrical connector assembly in accordance with a preferred embodiment of the present invention including a lower connector, an upper connector and a transition device, in conjunction with a mating connector and a PCB.

Reference will now be made to the drawing figures to describe the present invention in detail.

Referring to FIG. 1, a stacked electrical card connector assembly 1 in accordance with the present invention comprises an upper electrical connector 10, a lower connector 20, and a transition device 30 for connecting both the upper connector 10 and the lower connector 20 with a printed circuit board (PCB) 2. The connector assembly 1 is mounted on the PCB 2 with one end of the transition device 30 inserted into a mating connector 4 on the PCB 2.

Figure 2:
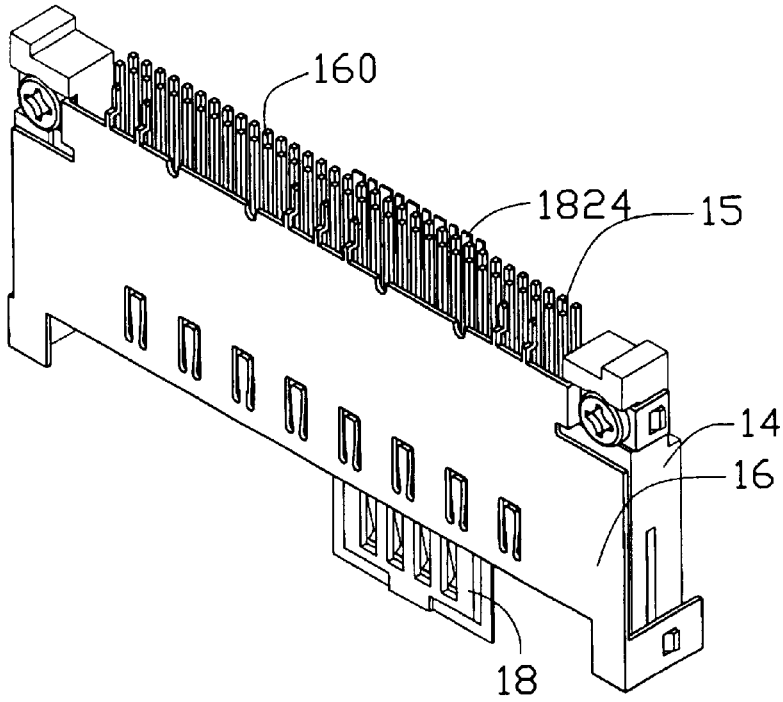
FIG. 2 is a perspective view showing an upper header of the upper connector of FIG. 1 including a contact module, an insulative main body and a metallic shield.
Figure 3:
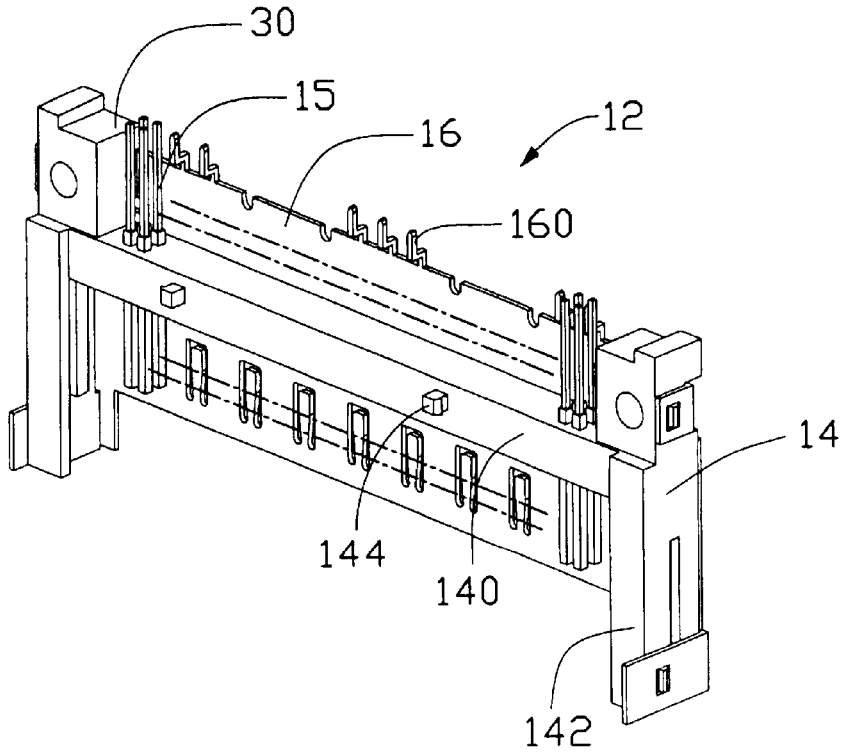
FIG. 3 is another perspective view of the insulative main body and the metallic shield of FIG. 2.
Figure 4:
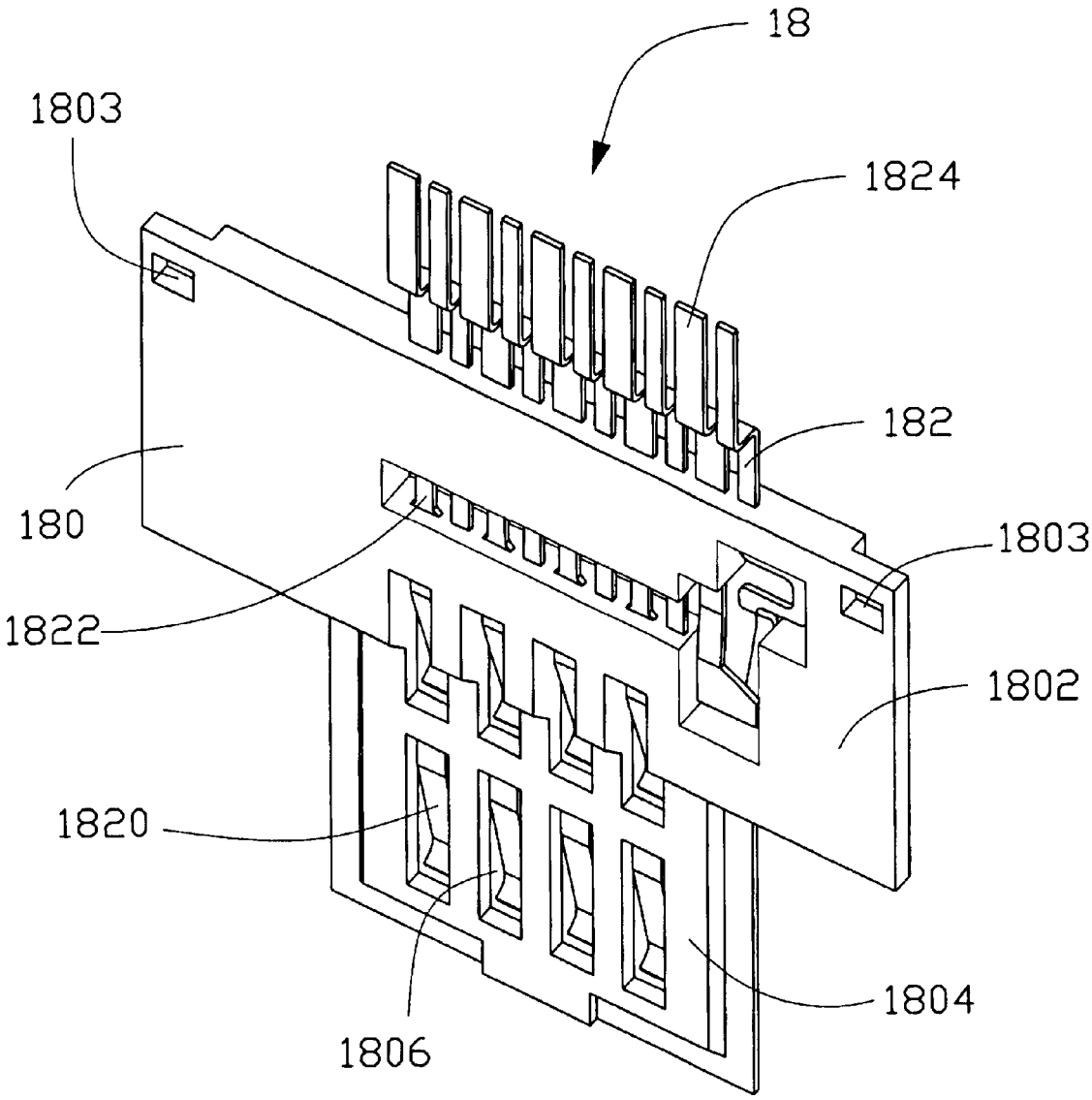
FIG. 4 is a perspective view of the contact module of FIG. 2.

Referring to FIGS. 2 and 3, an upper header 12 of the upper connector 10 comprises an insulative main body 14 and a metallic shield 16 covering a top surface of the main body 14. A contact module 18 is assembled to a bottom surface of the main body 14. The main body 14 has a middle bar 140 and a pair of guiding arms 142 extending from the middle bar 140. Two rows of signal contacts 15 are arranged along the middle bar 140. The middle bar 140 further has a pair of latches 144 defined on the bottom surface thereof. The shield 16 has a plurality of grounding pins 160 extending from an edge thereof. Referring to FIG. 4, the contact module 18 comprises an insulative block 180 and one row of electrical contacts 182 arrayed in the block 180. The block 180 has a base portion 1802 and a receiving portion 1804 extending from the base portion 1802. Each contact 182 includes a contacting portion 1820 received in a corresponding receiving slot 1806 of the receiving portion 1804, a locating portion 1822 secured in the base portion 1802 of the block 180, and a tail portion 1824 extending out of the base portion 1802. The base portion 1802 of the block 180 further has a pair of locking holes 1803 for receiving the latches 144 of the middle bar 140 therein. The contact module 18 is secured to the main body 14 with the electrical contacts 182 being arranged under the signal contacts 15.

Figure 5:
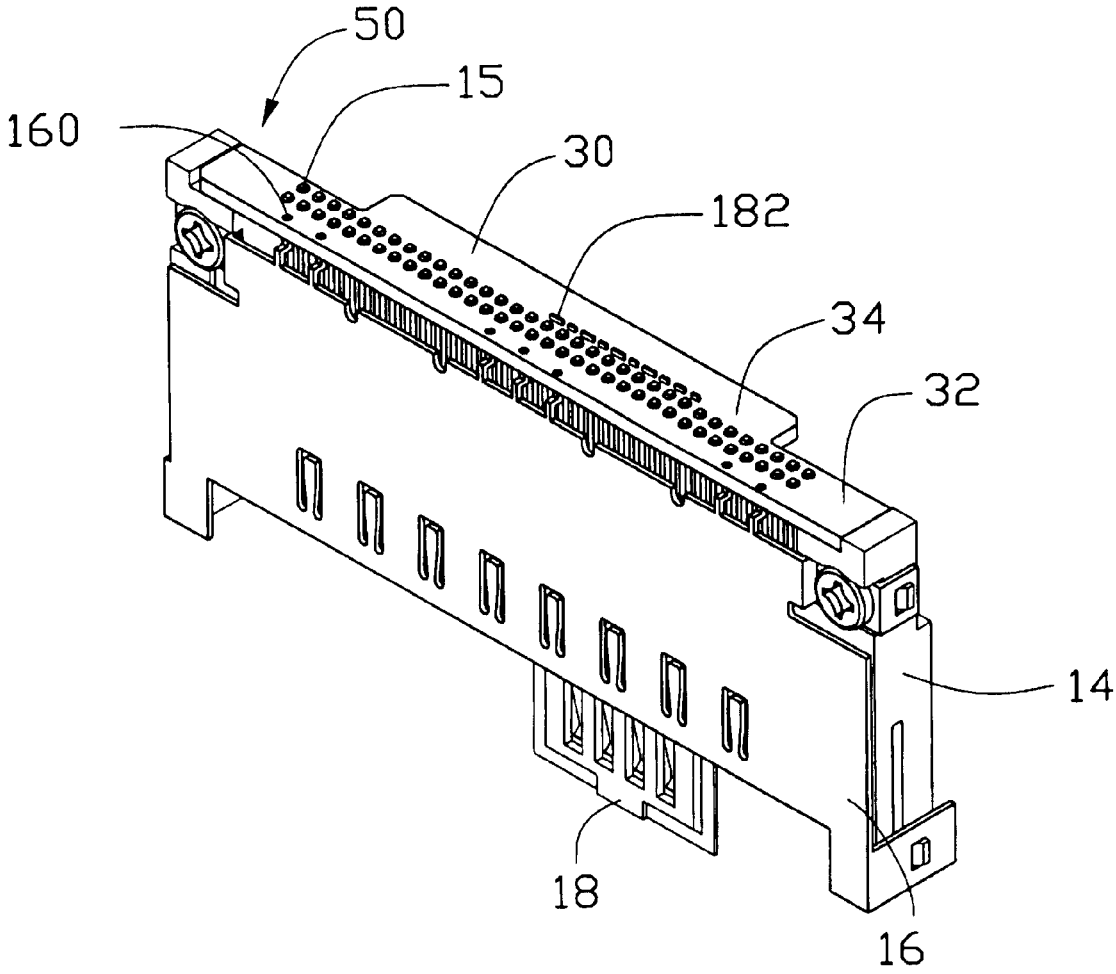
FIG. 5 is a perspective view showing the upper header of FIG. 2 connected with a transition device.

FIG. 5 shows a transition device 30 which is mounted to the upper header 12 to form a subassembly 50. The transition device 30 is a transition printed circuited board (transition-PCB), which comprises a first contacting portion 32 and a second contacting portion 34. The first contacting portion 32 has a plurality of rows of solder holes respectively connected with tail portions 1824 of the electrical contacts 182, the signal contacts 15, and the grounding pins 160 of the shield 16 when the transition device 30 is mounted to the middle bar 140 of the upper header 12. The second contacting portion 34 extends from one edge of the first contacting portion 32 for inserted into the mating connector 4.

Figure 6:
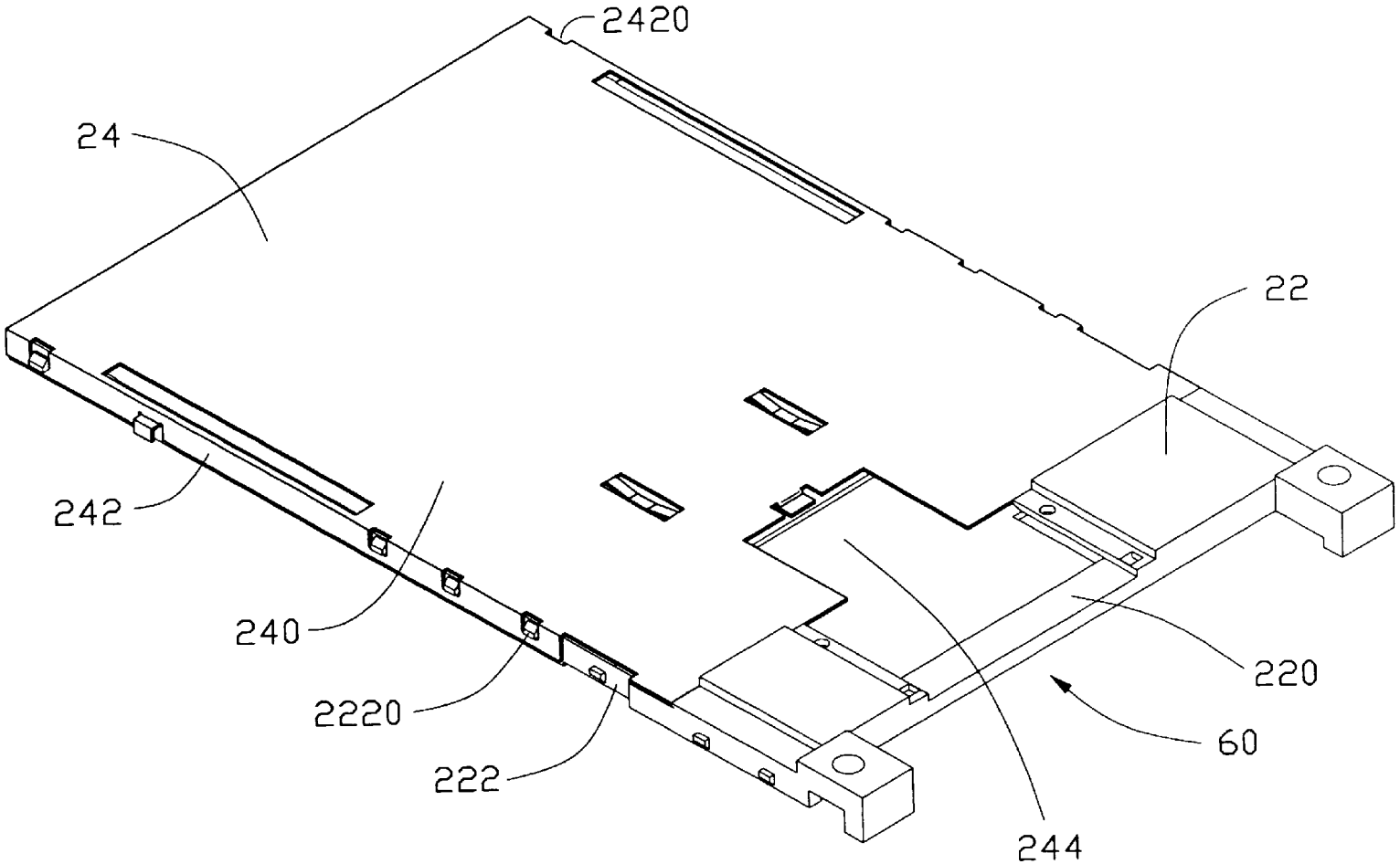
FIG. 6 is a perspective view showing a metallic lower frame and a lower header of the lower connector of FIG. 1.

FIG. 6 shows an insulative lower header 22 assembled with a metallic lower frame 24 of the lower connector 20 to form a subassembly 60. The lower header 22 comprises a lower main body 220 and two parallel guiding arms 222 extending out from opposite ends of the main body 220. Each arm 222 has a plurality of ribs 2220. The lower frame 24, which is formed by stamping a metal sheet, comprises a base plate 240. Opposite sides of the base plate 240 are bent downwardly and inwardly to form a pair of flanges 242. A plurality of locking holes 2420 are disposed along the flanges 242 for engaging with the ribs 2220 of the lower header 22 to secure the lower frame 24 on the lower header 22. The base plate 240 also defines an opening 244 at one end opposite to the main body 220.

Figure 7:
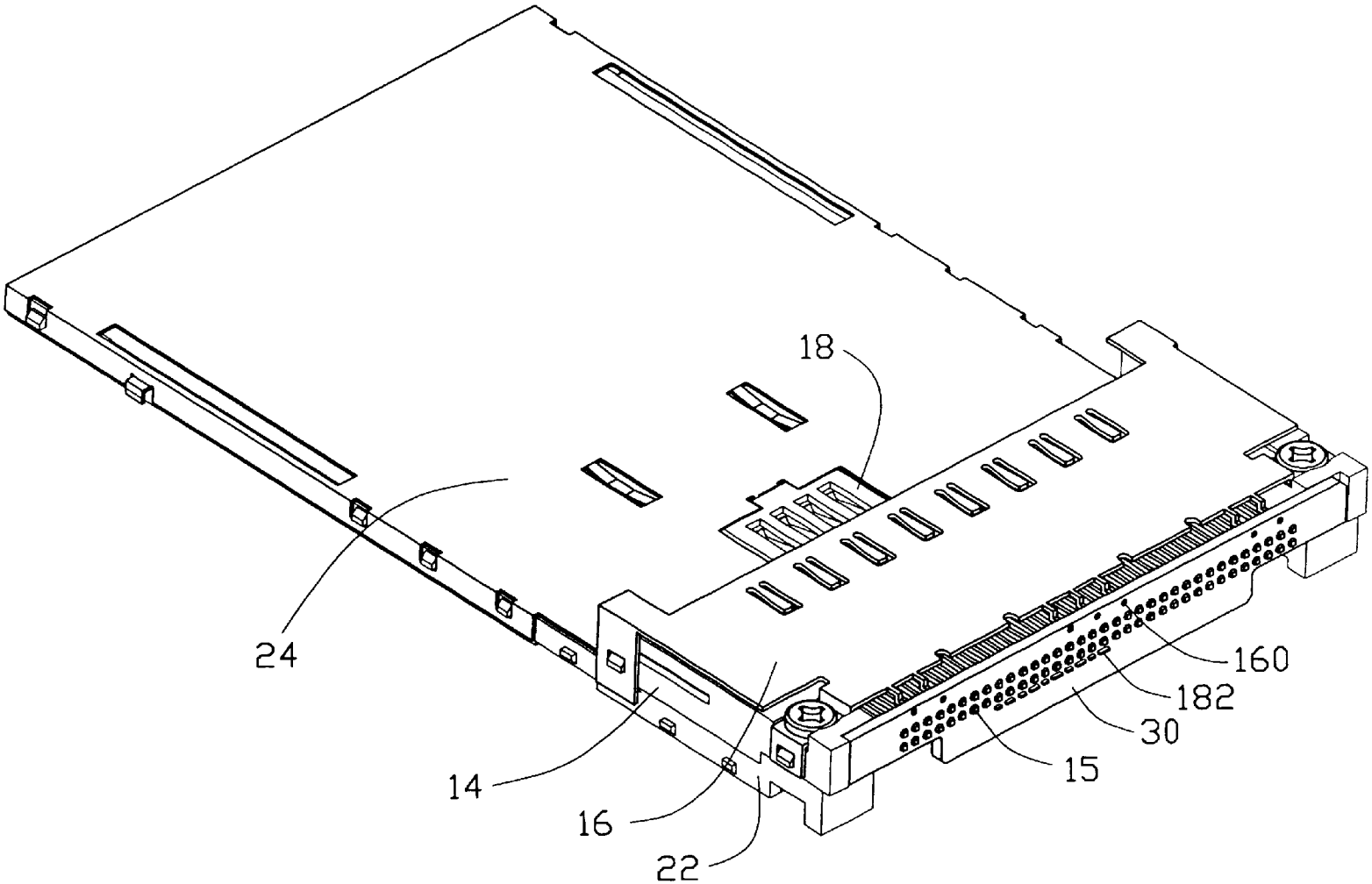
FIG. 7 is a perspective view showing the assembly of FIG. 5 assembled on the lower header of FIG. 6.
Figure 8:
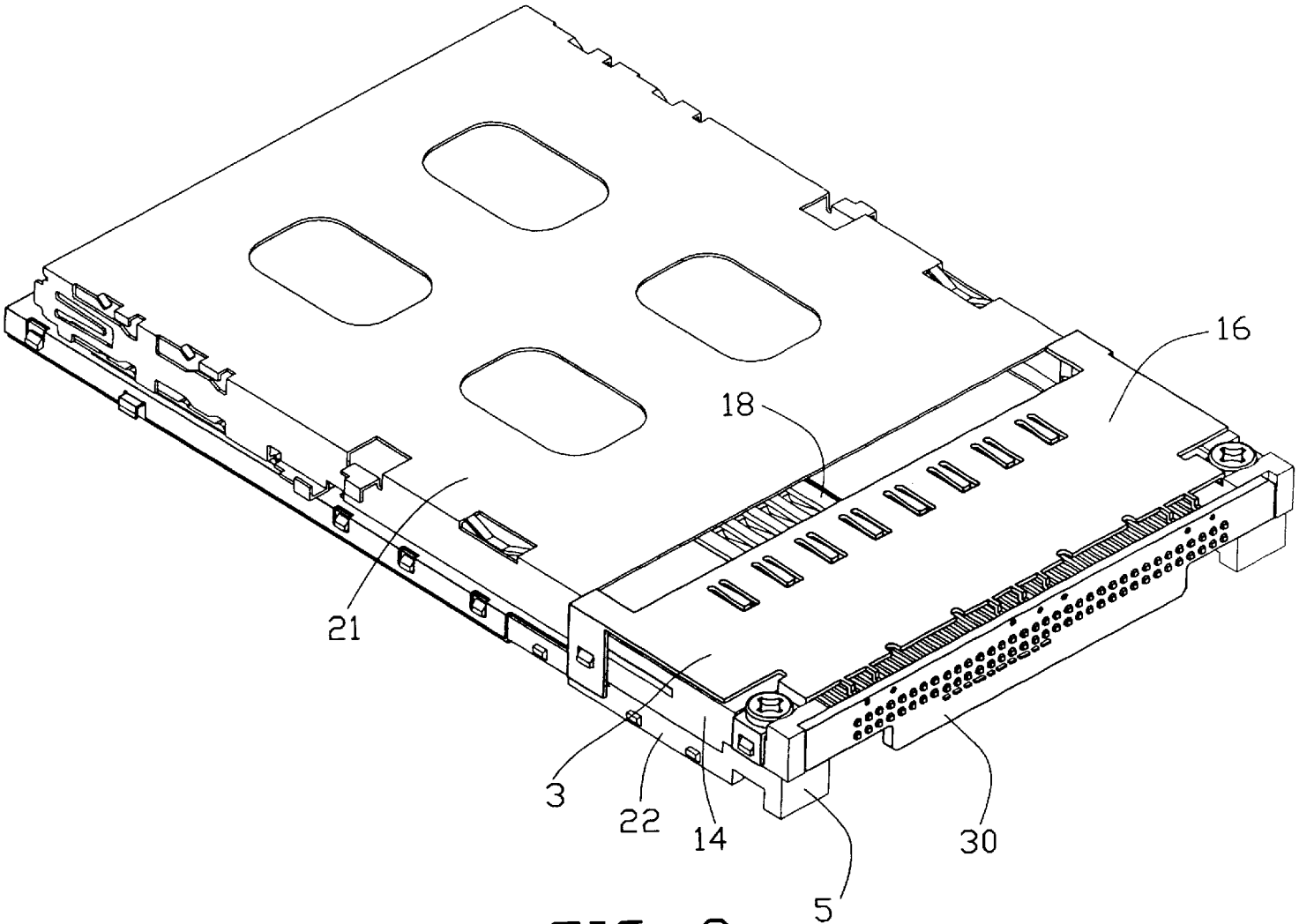
FIG. 8 is a perspective view of the electrical connector assembly of FIG. 1.

Referring to FIG. 7, the subassembly 50 is assembled to the subassembly 60 with the upper header 12 being stacked on the lower header 22. The receiving portion 1804 of the block 180 of the contact module 18 is positioned in the opening 244 of the lower frame 24. Then, electrical card received in the lower frame 24 can electrically connected with the contacting portions 1820 of the electrical contacts such that data of electrical card can be transmitted through the transition device 30. Referring to FIG. 8, a metallic upper frame 19 is stacked on the lower frame 24 to form a receiving space for receiving another electrical card therein. Thus, the electrical card received in the upper frame 19 can electrically connect with the signal contacts 15 of the upper header 14 such that data of electrical card can also be transmitted through the transition device 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly mounted on a PCB for interconnecting inserted electrical cards with the PCB, comprising:

an upper connector having an upper header, the upper header comprising an insulative main body and a metallic shield covering the main body, a plurality of first signal contacts being received in the main body;

a lower connector having an insulative lower header, a metallic lower frame assembled to the lower header, and a contacting module having an insulation block with a base portion, the contacting module being assembled to the main body of the upper header and having a plurality of second signal contact defined under the first signal contacts, the lower frame having a opening defined at one end opposite the lower header thereby defining a receiving space to receive a part of the contacting module therein;

a transition device having a first contacting portion, the first contacting portion having a plurality of solder holes respectively receiving the first and second signal contacts therein; wherein the transition device comprises a transition printed circuit board and has a second contacting portion connected with the first contacting portion, the second contacting portion being connected with a mating connector mounted on a PCB; wherein the main body has a pair of latches, and a pair of locating holes is defined in the base portion of the contacting module and engage with the latches, thereby securing the contacting module to the upper header.

2. The stacked electrical card connector assembly as claimed in claim 1, wherein the shield of the upper connector has a plurality of grounding pins extending out from an edge thereof and inserted into the solder holes of the first contacting portion of the transition device.

* * * * *